United States Patent [19]

Cruse et al.

[11] Patent Number: 4,728,035

[45] Date of Patent: Mar. 1, 1988

[54] APPLICATION OF PARTICLES TO A SUBSTRATE

[75] Inventors: John W. Cruse, Robertsbridge; William O'Callaghan, Gerrards Cross, both of United Kingdom

[73] Assignee: P.T. Chemicals Limited, Buckinghamshire, England

[21] Appl. No.: 29,049

[22] PCT Filed: Jun. 30, 1986

[86] PCT No.: PCT/GB86/00380

§ 371 Date: Feb. 25, 1987

§ 102(e) Date: Feb. 25, 1987

[87] PCT Pub. No.: WO87/00090

PCT Pub. Date: Jan. 15, 1987

[30] Foreign Application Priority Data

Jul. 1, 1985 [GB] United Kingdom ..... 8516638

[51] Int. Cl.[4] ..... B05B 1/28; B05B 3/02; B05B 1/26

[52] U.S. Cl. ..... 239/122; 239/222; 239/288.5; 239/519

[58] Field of Search ..... 239/120–122, 239/222, 228, 228.5, 289, 498, 517, 519, 598, DIG. 14

[56] References Cited

U.S. PATENT DOCUMENTS

| | | | |
|---|---|---|---|
| 2,748,411 | 6/1956 | O'Brien | 15/129 |
| 3,014,812 | 12/1961 | Sallie | 117/24 |
| 3,749,315 | 7/1973 | Crathern | 239/224 |
| 3,829,019 | 8/1974 | Petsch | 239/288.5 X |
| 4,473,188 | 9/1984 | Ballu | 239/121 |

FOREIGN PATENT DOCUMENTS

| | | |
|---|---|---|
| 3243113 | 5/1984 | Fed. Rep. of Germany . |
| WO84/04315 | 11/1984 | PCT Int'l Appl. . |
| 158432 | 3/1921 | United Kingdom . |
| 196416 | 5/1923 | United Kingdom . |

*Primary Examiner*—Andres Kashnikow
*Assistant Examiner*—Patrick N. Burkhart
*Attorney, Agent, or Firm*—Howson and Howson

[57] ABSTRACT

Apparatus for producing a spray of particles includes a shroud for restricting the spray produced by an atomizer, leaving a restricted arc or arcs over which particles can be ejected from the apparatus. The shroud includes at least one shielding element comprising an array of bristles. Each array of bristles can be carried by a flexible elongate element so that the form and extent of the array can be adjusted. The atomizer can be a rotary atomizer.

11 Claims, 15 Drawing Figures

APPLICATION OF PARTICLES TO A SUBSTRATE

Figure 1:
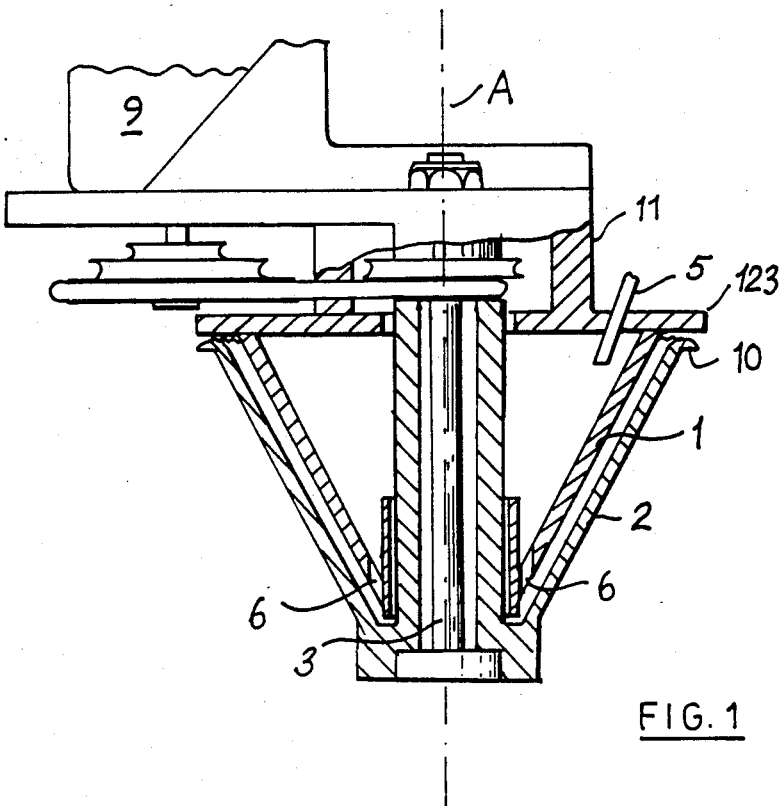

This invention relates to the production of a spray of particles for application to a substrate. The substrate may be a moving web, for example, a web of pasty material constituting a precursor of paper or board in the manufacture of those materials.

A spray of particles may be generated in a number of ways. One apparatus for generating a spray of liquid particles is the rotary atomiser described in the specification of International Patent Application Publication No. WO84/04315. If it is desired to restrict the arc of the spray of liquid particles by placing shrouds about the means producing the spray, for example in the case of a rotary atomiser by surrounding part of the circumference of the atomiser with a shield so as to restrict the passage of liquid particles to the space beyond the shield, difficulties can arise in that use of a rigid shroud or shield at a distance from the means producing the spray of liquid particles is associated with the presence of liquid particles so fine that they can persist in the atmosphere for an inordinately long period of time and can pervade the space in which the spray producing means is located.

The present invention is based on the discovery that the incidence of such fine droplets can be reduced by using a shielding element comprising an array of bristles, a bristle being a yieldable hair or filament. The invention can, however, also be used in connection with the production of a spray of solid particles and the shrouding and restricting of such a spray.

Accordingly, an apparatus according to the invention for producing a spray of particles, comprises means for generating a spray of particles and shrouding means arranged about said spray producing means leaving a restricted arc or arcs over which particles can be ejected from the apparatus, the shrouding means including at least one shielding element comprising an array of bristles.

The length, thickness, stiffness and spacing of the bristles are chosen so as to achieve effective absorption by the array of bristles of the particles directed at the array, taking account of the size and velocity of the particles and the density of the particles.

Advantageously, the shrouding means is so arranged above a trough that fluent material intercepted by the shrouding means will flow down into the trough. It is also advantageous if the general direction of the bristles, in at least part of the array of bristles, forms an included angle of less than a right angle with the general direction of the particles impinging upon that part of the array. In this way the effect of the impact of the particles on the array is lessened and the tendency to secondary atomisation, in the case of liquid particles, is reduced.

The invention may be used in a method of applying a spray of particles to a substrate, the method comprising generating a spray of particles, arranging shrouding means to intercept some of the particles of the spray but leaving a restricted arc or arcs over which particles can be ejected to reach the substrate, the shrouding means including at least one shielding element comprising an array of bristles.

The means for producing the spray of particles may comprise a spinnable member and, in the case of liquid particles, the spinnable member may be part of a rotary atomiser.

One use for the apparatus and method according to the invention is in the application of a spray of liquid particles to the surface of a paper or board or to the surface of a web which is the precursor of paper or board.

Some properties of paper or board can be desirably influenced by applying materials to a surface of a web precursor of the paper or board. In some circumstances the materials are in liquid form and have to be applied to the web when it is in a semi-liquid state and can thus be easily damaged by impact from droplets issuing from a conventional spray nozzle. The rotary atomiser already mentioned, described in the specification of International Patent Application Publication No. WO84/04315 may then be used to apply droplets to the web precursor. Where such a rotary atomiser is disposed with the axis of its conical shell vertical and its closed end lowermost, the locus of the droplets produced corresponds approximately to the canopy of an open umbrella, the trajectory of each droplet turning from horizontal towards the vertical as the radial velocity of the droplets falls. A stationary horizontal web disposed below such a rotary atomiser will receive droplets over an annular surface centred on the axis of the conical shell and since the vertical component of the velocity of each droplet as it strikes the web is, ignoring air resistance, a function of the height of the periphery of the shell above the web, a rotary atomiser provides one way of coating a very fragile web (such as the wet fibres layer on a Fourdrinier screen of a paper-making machine) with a liquid material without damaging the web.

When the web is moving relative to the rotary atomiser, the surface on which droplets are deposited becomes a strip whose width is equal to the outer diameter of the annular surface.

The aforementioned International Application Specification No. WO84/04315 also mentions the possibility of using a number of rotary atomisers simultaneously in applying a liquid to a web and of surrounding part of the periphery of the spinning shell of a rotary atomiser with a shield to permit directional application of liquids to be made as and when required by the user. This invention provides an advantageous form of shroud which is especially useful in shrouding rotary atomisers producing droplets of liquid.

The spray may be a circular spray of particles generated by a spinning member and in the simplest embodiment of the method, a spinning member is used which would generate an annular deposit area whose diameter is greater than the width of a surface to be treated with the fluent material and the deposit area is masked back to a leading and a trailing arc over which the desired degree of uniformity of deposition is achieved. By limiting the deposit pattern to at least one arc (typically one that subtends an angle of no more than $\pm 45°$ at the centre of the deposit pattern), a greatly improved uniformity of deposit can be obtained than if the regions of the annular deposit area whose tangents are only slightly inclined to the transverse direction of the surface are allowed to contact the surface.

Where masking off regions of the circular spray results in a spray deposit area which is not wide enough to cover the required width of a surface, more than one masked-off circular spray can be generated and the deposit areas resulting from the sprays can be positioned on the surface to abut one another and thereby cover the required width.

For continuous coating of surfaces, it is necessary to have relative motion between the surface and the apparatus for producing the spray of particles and normally this will be achieved by keeping the or each apparatus stationary and moving the surface relative to it/them. In the case of a rotary atomiser producing a planar spray of liquid particles, the plane of the spray pattern can be parallel to the surface on which the particles are to be deposited (this represents a first limiting case) or the two planes can intersect. The second limiting case is when the surface extends normal to the plane of such a circular spray and this second limiting case can be a useful arrangement in some circumstances, although the particles will be impinging on the surface with their radial velocities and this may be too energetic an impact for some fragile webs although application to a wet paper web via the wire side is possible using an intersecting planes arrangement.

Preferably the means used to mask off regions of the spray intercepts the particles shortly after their formation and causes them to coalesce for return to a reservoir.

Figure 2:
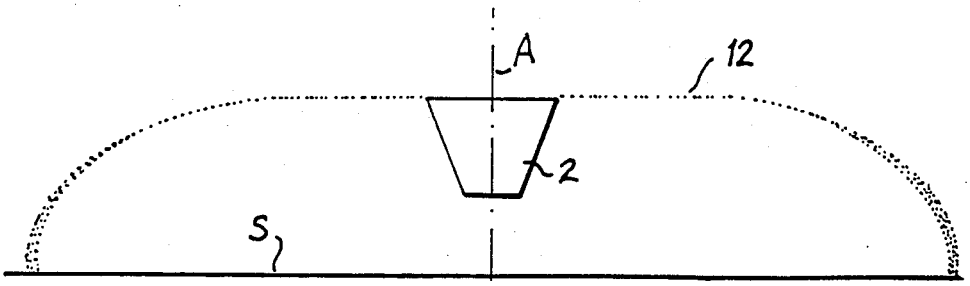
Figure 3:
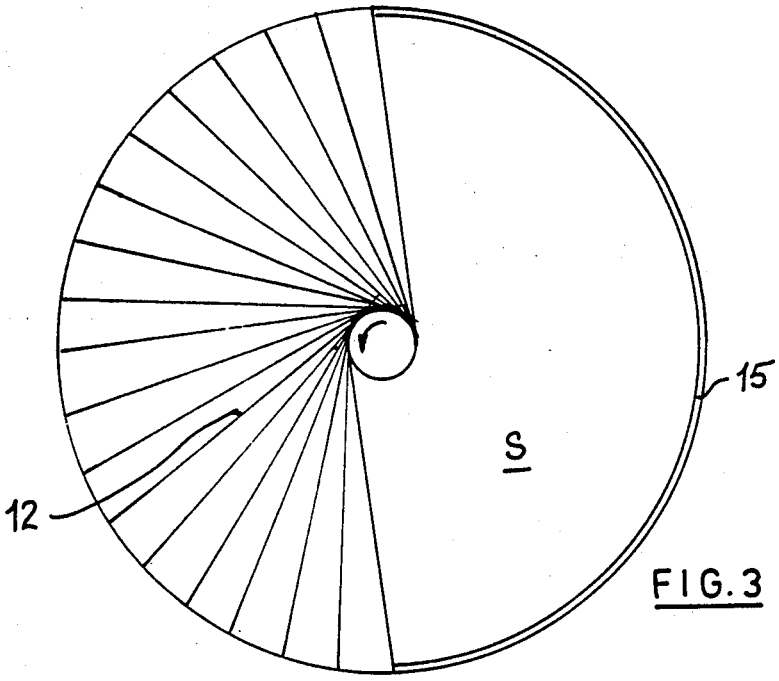
Figure 4:
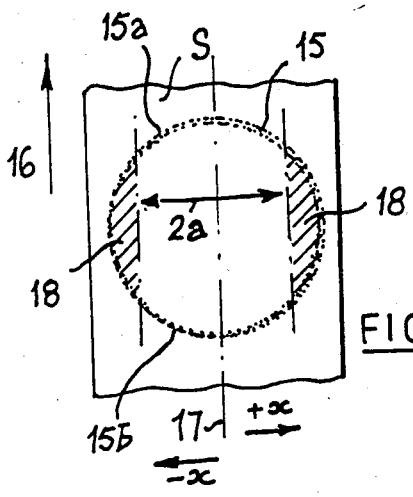
Figure 5:
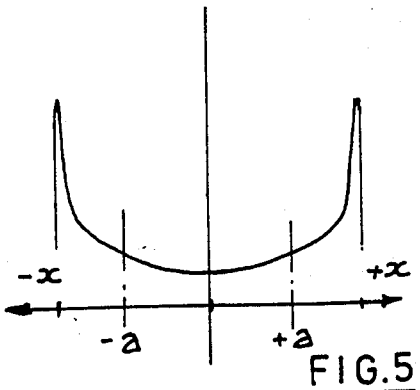
Figure 6:
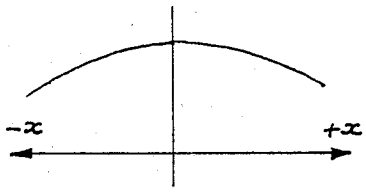
Figure 7:
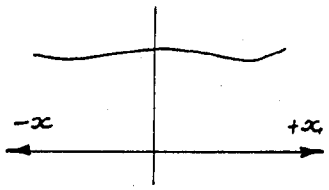
Figure 8:
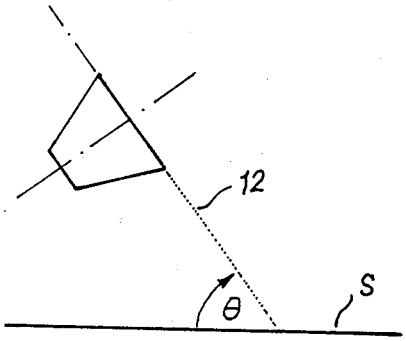
Figure 10:
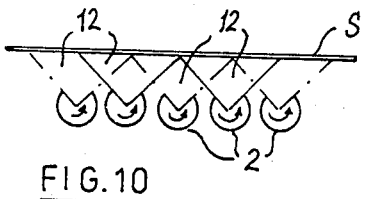
Figure 9:
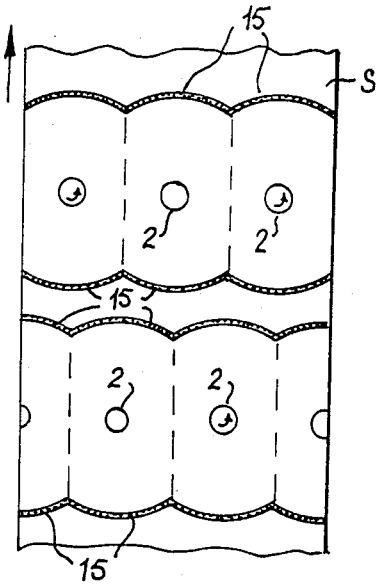
Figure 11:
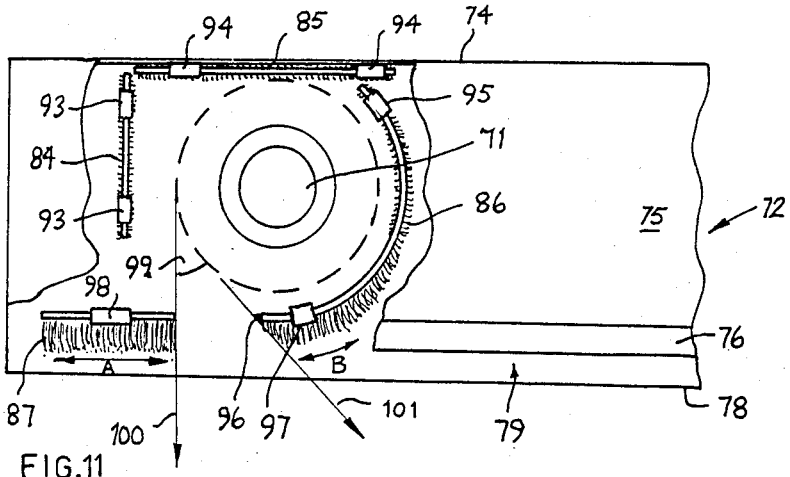
Figure 13:
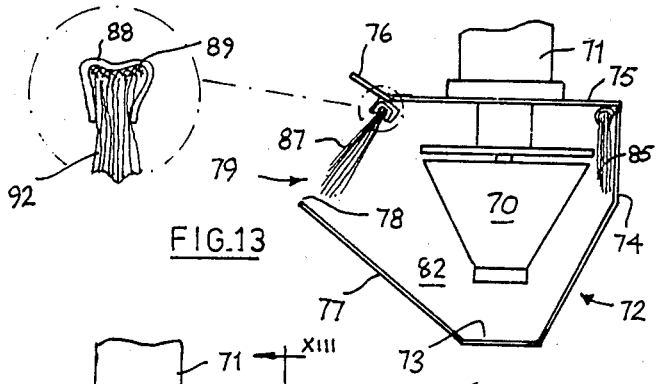
Figure 12:
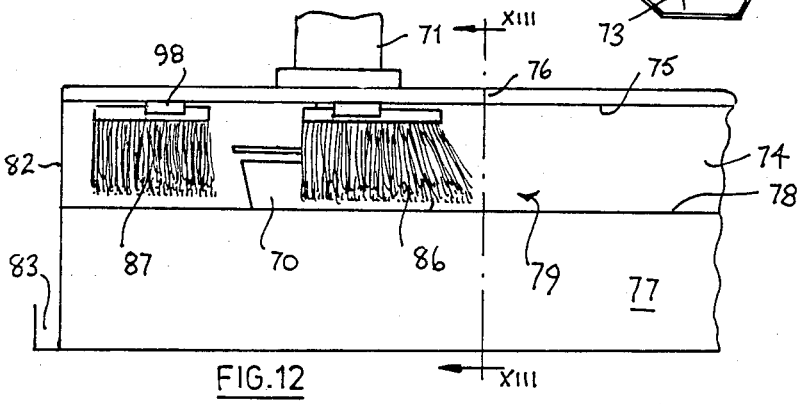

The invention will now be further described, by way of example, with reference to the accompanying drawings, in which FIG. 1 is a cross-sectional view of a preferred form of rotary atomiser for producing a spray of liquid particles, FIG. 2 is a sectional side view of the "canopy" of droplets formed by the atomiser of FIG. 1 when disposed just above a surface to be coated and operating with its rotational axis vertical, FIG. 3 is a plan from above of the canopy shown in FIG. 2 showing the droplet trajectory in the left-hand half and the annular deposit area in the right-hand half, FIG. 4 shows how, according to the invention, outer regions of the annular deposit area are masked off to leave leading and trailing deposit arcs, FIG. 5 shows a graph of the density of droplets per unit area in the deposit area of FIG. 4 at differing transverse distances from the centre of the deposit area in the case where the initial circular spray and the surface to be coated are parallel to one another, FIG. 6 is a graph which corresponds to FIG. 5 but shows the distribution when the plane of the initial circular spray is normal to the plane of the surface to be coated (i.e. $\theta=90°$ in FIG. 8), FIG. 7 is a graph which shows the distribution made more uniform by the apparatus of the invention when applied to the case of intersecting planes, FIG. 8 shows a schematic set up where the planes intersect at an angle $\theta$, FIGS. 9 and 10 show, in plan, how a plurality of masked-off deposit patterns can be combined to give a wider uniform distribution than is possible with a single rotary atomiser, FIG. 11 is a plan of an apparatus according to the invention using an array of bristles as shielding means, FIG. 12 is an elevation of the apparatus of FIG. 11, FIG. 13 is a cross-section on the line XIII—XIII of FIG. 12.

Figure 14:
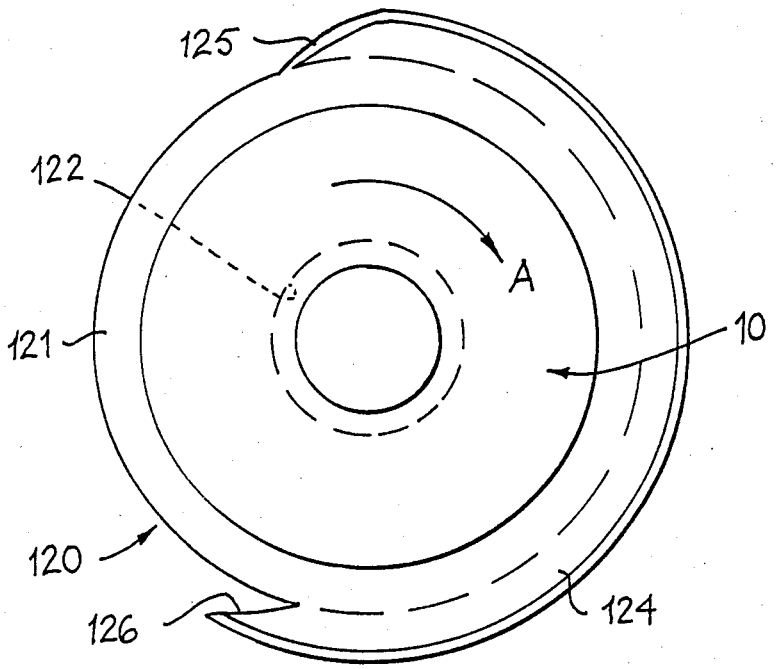
Figure 15:
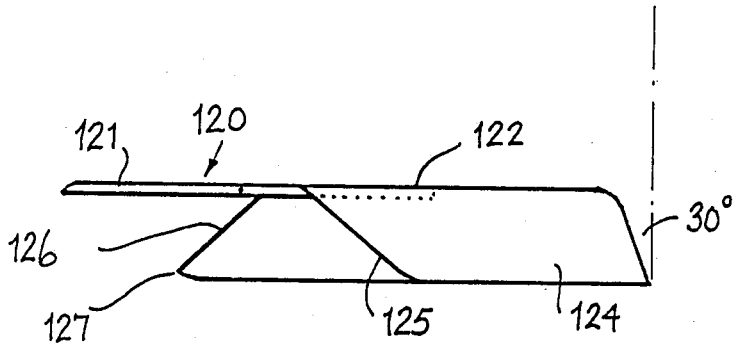

FIG. 14 is a view from underneath showing a rotary atomiser with a rigid shroud which may be used in conjunction with shrouding means including an array of bristles, and FIG. 15 is a side view of the rigid shroud shown in FIG. 14.

Referring to FIG. 1 the rotary atomiser comprises a fixed inner cone 1 surrounded by an outer cone 2 rotatably mounted on a support shaft 3 coaxial with the axis A of the atomiser and constituting a spinning member from which emanates in use, a substantially planar circular spray of droplets. A prime mover 9 (which could be an electric, pneumatic or hydraulic motor) rotates the outer cone 2 at a speed of a few thousand rpm and the fluent material to be dispensed (normally a liquid) is fed via a pipe 5 to the interior of the inner cone 1 where it flows into the base of the outer cone through the openings 6.

The interior surface of the outer cone 2 is grooved with channels (not shown) that extend up to the peripheral edge 10 of the outer cone 2 and there manifest themselves as uniformly spaced-apart teeth. Droplets, that is liquid particles, are created by the liquid flowing up the channels in the cone 2 under the influence of the centrifugal force and then being flung from the spinning peripheral edge of the cone 2 to form a circular spray 12 of droplets which are coplanar with the peripheral edge 10 of the cone 2. FIG. 2 shows how this circular spray 12 is influenced by air resistance and gravity in the case of the axis A being vertical, the locus of the droplets defining a surface somewhat akin to the canopy of an opened umbrella formed above the surface S on which the droplets fall. FIG. 3 shows, on the left, the tangential issue direction of each droplet and on the right the narrow annular deposit area 15 over which the droplets impinge on the surface S.

For a given atomiser and a liquid of given rheological properties and set spinning at a given speed of rotation, droplets of substantially uniform size are generated. It follows that droplet size can be selected by choosing an appropriate combination of atomiser geometry, fluid rheology and speed of rotation in order to meet the particular requirements of the user. Each of the parameters governing droplet size may be adjusted independently of the others and also independently of the rate of flow of the suspension or solution being applied to the surface. With a conventional spray nozzle, the droplet size is dependent on the pressure drop across the nozzle which, in turn, governs the rate of flow. Since the droplets produced by the atomiser are of virtually uniform size, they follow similar trajectories thus permitting a remarkably close degree of control of the pattern laid down on the paper surface. With the droplets ejected from the rotating atomiser spinning about a vertical axis, they will start travelling in a horizontal direction and as they are slowed by air resistance, the force of gravity will become increasingly dominant, causing the locus of each droplet to curve down to contact the surface S. The radius of the annular deposit area 15 is about 100 cm and its radial extent may be as low as 2 to 3 cm when a cone 2 of some 15 cm diameter is used at a speed of 4000 rpm but may be as large as 20 to 30 cms under some conditions. If the atomiser is placed so that the base of the cone 2 is close to the surface S the droplets will have fallen through approximately 20 cm in the vertical direction under the force of gravity and so will contact the surface S very much more slowly than would similar droplets ejected at high velocity from a conventional pressure-operated spray nozzle. This is particularly advantageous when a fluent material is to be applied to the surface of paper or board during the early stages of manufacture when the water content of the paper is high and the strength of the paper web is consequently very low.

FIGS. 4 to 8 illustrate the essential features of the method of the invention. The distribution of droplets on the surface S when the latter is moving in the direction shown by the arrow 16 in FIG. 4 is as shown in FIG. 5 where x is the distance to left and right of the central line 17 in FIG. 4. Thus it can be seen that the annular deposit area 15 results in a density of deposit which increases with increasing x (apart from the final tail off) but that there is an area close to the central line where the deposit is substantially uniform. By masking off the side areas 18 shaded in FIG. 4 ($x \geqq a$) and allowing the droplets to fall only in a leading arc 15*a* and a trailing arc 15*b*, it is possible to achieve a much more uniform deposit distribution per unit area of the web. The width 2*a* of the deposit band between the masked areas 18 will normally range from between 30 and 90% of the diameter of the area 15 and desirably will not exceed 70% of the diameter and preferably will not exceed 50% of the diameter.

FIG. 6 shows the change in density of droplet distribution in the case of the plane of the issuing circular pattern of droplets being normal to the plane of the impinged surface, whereby the droplets all strike the surface travelling normal thereto. In this limiting case of the intersecting plane arrangement, the distribution drops off from the centre line with increasing "x" and this is shown in FIG. 6.

By impinging the planar circular spray pattern on the surface S at an angle as shown in FIG. 8 it is possible to obtain a distribution roughly as shown in FIG. 7 which is a combination of the FIGS. 5 and 6 distributions.

FIG. 9 shows a spray pattern arrangement which gives very good uniformity in the case of a plurality of rotary atomisers (in this case seven) masked down to generate leading and trailing arcs of just 60° in the case of the three front row atomisers and the two central atomisers in the rear row and masked down to an arc of just 30° in the case of the two outer atomisers in the rear row. This arrangement gives a near perfectly uniform distribution in the case of the initial spray pattern being parallel to the surface to be coated.

A very good uniform distribution can be achieved in the case of the surface being normal to the plane of the initial spray pattern with the arrangement shown in FIG. 10 where each atomiser is masked back to leave a spray subtending just 90° at the axis of the atomiser, the atomisers being spaced apart so that their spray patterns overlap by 50% with the spray pattern on each side thereof.

Referring now to FIGS. 11 to 13, there is shown in those Figures an apparatus for producing a spray of particles which is ejected from the apparatus over a restricted arc. The apparatus comprises a rotary atomiser 70 of the kind shown in FIG. 1 but driven in this case by an air motor 71. The rotary atomiser 70 is mounted within a cowling 72 comprising a trough 73, a vertical rear wall 74 and a roof 75. A flange 76 at the front edge of the roof 75 is parallel to the upwardly and forwardly inclined front wall 77 of the trough 73 and together with the upper edge 78 of the front wall 77 defines a slot 79 through which atomised droplets of liquid may leave the cowling 72.

The cowling 72 is shown with an end wall 82 and a duct 83 opening into the trough 73 to carry away liquid thrown off by the rotary atomiser 70 but prevented from leaving the cowling. On the opposite side of the rotary atomiser 70 from the end wall 82 the cowling 72 is shown cut away. The cowling 72 may extend in this direction to accomodate further rotary atomisers or, if it is to accomodate only one rotary atomiser, it may be completed with a further end wall.

The cowling 72 serves as part of shrouding means arranged about spray-producing means (the rotary atomiser 70) to restrict the arc over which liquid droplets can be ejected from the apparatus. The shrouding means also includes four shielding elements 84,85,86 and 87 each comprising an array of bristles secured in an elongated element constituted by a channel member 88 by a body of adhesive 89 in which end portions of the bristles 92 are embedded. Each channel member 88 has a degree of flexibility and can be formed into a curve as shown in FIG. 11 in the case of the shielding element 86. The cowling 72, being located beyond the arrays of bristles in relation to the atomiser 70, is shielded from the spray of particles produced by the atomiser by the arrays of bristles.

The channel members 88 are held by metal channel-shaped clamping members secured within the cowling 72. Two clamping members 93 hold the shielding element 84 firmly in this way and two clamping members 94 hold the shielding element 85. A clamping member 95 holds the channel member 88 of the shielding element 86 firmly near the end of this channel member 88 adjacent the rear wall 74 of the cowling 72. The other end portion 96 of the channel member 88 of the shielding element 86 is slidably held in a clamping member 97 so that the position of the adjacent end of the shielding element 86 can be adjusted (in the directions "B") by sliding its channel member 88 within the clamping member 97, which holds the channel member 88 sufficiently firmly so that the channel member will remain in the position to which it is adjusted within the clamping member 97.

The shielding element 87 is similarly held in a clamping member 98 and can be adjusted in position (in the directions "A") by sliding it within the clamping member 98.

In the positions shown, the shielding elements 86 and 87 allow droplets to be ejected from the apparatus over an arc 99 between the limiting trajectories 100 and 101. The length of the arc 99 can be adjusted by sliding the shielding element 87 in its clamping member 98 and by sliding the end portion 96 of the shielding element 86 in the clamping member 97. The latter operation will cause the channel member 88 of the shielding element 86 to adopt a slightly different curved form from that shown in FIG. 11. The curve will be tighter or more gradual depending on the direction of the adjustment. Thus the form and extent of the array of bristles can be adjusted.

Advantageously, by tightening the curve of the shielding element 86, the bristles are caused to "splay" outwardly and downwardly as shown causing the included angles between the horizontal direction of the trajectory of the droplets of spray and the direction of the bristles at the point where the particles concerned impinge upon the array of bristles to be less than a right angle. In all cases, with the arrangement of shielding elements shown, the included angle between the particle direction at any point of impingement and the length direction of the array of bristles concerned is less than a right angle. Such dispositions of the bristles reduce any tendency to secondary atomisation by making the deceleration of the droplets against the bristles more gradual. Advantageously the inclined angles are less than 60° and preferably less then 30° over the whole or a substantial part of the regions of the array or arrays of bristles which interact with the droplets.

The bristles are chosen as to length, thickness, stiffness and spacing to achieve effective absorption of the particles directed at them, taking account of the size and velocity of the particles and the density of the fluent material.

In the case of an aqueous starch dispersion, bristles of a relatively stiff synthetic polyamide and from 5 to 9 cm long, advantageously 6.5 cm long, and from 0.2 to 0.3 mm in diameter, advantageously 2.5 mm in diameter, can be used.

The bristle shielding means may comprise a single array of bristles surrounding the spray-producing means except over the arc where particles are to be ejected from the apparatus.

The invention can be used in a wide range of situations where a fluent material needs to be deposited uniformly on a surface. Thus, for example, in the dispensing of agrochemicals onto a tract of land or a crop growing thereon, masking off regions of the spray pattern generated by a spray-producing means can result in safer, more accurate and/or more economic use of the chemicals. By arranging for the arc of spray not masked off, to be variable from the cab of a tractor transporting the or each rotary atomiser and by ensuring that in the limiting case all material released by the spray-producing means is caught by a shroud, an operator can cease the application of the material very rapidly (e.g. at the end of a run across a field, on the approach of a gust of wind or on other occasions when continued application is unnecessary or undesirable).

Another situation where the invention can be used is in the liquid treatment of textiles. In this case it is to be expected that the surface will move relative to a spray-producing means whose rotating axis is stationary rather than the converse as will apply in the various agricultural or horticultural situations. A wide range of different textile treatments are possible with a shrouded rotary atomiser including, for instance, dyeing, crease resisting, bonding non-woven fibres and texturising.

In the manufacture of paper or board, there are many applications. Details of some of the chemical additives which can be supplied using a masked-off rotary atomiser can be taken from an article entitled "Papermaking Additives" on pages 803 to 823 of the 3rd Edition, Volume 16, 1981 of Kirk-Othmer's "Encyclopedia of Chemical Technology". An array of masked-off rotary atomisers is particularly useful for applying liquid or semi-liquid functional internal additives at the wet end (i.e. from above and/or below the Fourdrinier wire) and various fluent functional surface additives at later stages in the web treatment process. Thus adhesives can be applied to selected areas of finished paper to make paper products or for laminating sheets together.

When apparatus in accordance with the invention is used above a fast moving web there can be advantage in locating the apparatus as close as possible to the web since that makes it possible to launch the particles of fluent material into the laminar air flows that move generally with the web. Conventional systems for dispensing sprays onto fast moving webs can operate in or above the region of turbulent air above the laminar air flows so that the particles are disturbed by the turbulent air and might not even land on the web at all.

Although a rotating cone (such as described with reference to FIG. 1) is expected to be the preferred form of spinning member for the dispensing of liquid or semi-liquid material, powder materials may be better dispensed from a spinning disc or a spider of tubes.

As mentioned above, when producing a spray of liquid droplets, the use of shrouding means including an array of bristles is associated with a reduction in the quantity of fine droplets emanating from the apparatus producing the spray. It is thought that this may be connected with the nature of the air flow in the region of an array of bristles at which a spray of droplets is directed, the air flow being such that the fine droplets are attracted to the bristles and adsorbed onto them. The same effect does not occur with a rigid shroud located at some distance, say 10 cm or more, from the means producing the spray of droplets. With a rigid shroud so located, fine droplets can be expected to emanate from the spray-producing apparatus whether due to secondary atomisation by impact with the rigid shroud or because fine droplets in the spray are not "collected" by the rigid shroud but may drift around and past it. An array of bristles does not have the effect of reducing the incidence of such fine droplets leaving the apparatus.

Additionally the edge of an arc of a spray of droplets created by interposing an array of bristles in the original spray, is a cleaner edge than if the edge of a rigid shroud is interposed in the original spray, in that the particle size distribution in the region of the edge of the spray remains much more uniform. A rigid shroud edge causes a number of larger droplets to be formed in the edge region of the arc of the spray and an array of bristles does not have the same disturbing effect. Formation of larger droplets in the edge region of the spray is disadvantageous since they have a different trajectory from the smaller standard droplets. In the case of a horizontal spray, they will fall short of the target area achieved by the standard droplets and may damage a delicate substrate on which they may fall.

Surprisingly, however, it has been found that a rigid shroud located close to the means producing a spray of liquid droplets can cause coagulation of droplets rather than secondary atomisation and such a shroud can be used advantageously in conjunction with a shroud including an array of bristles.

FIG. 14 shows a rigid shroud 120 located close to the peripheral edge 10 of the cone 2 of a rotary atomiser such as that shown in FIG. 1.

The shroud 120 comprises a circular disc 121 of synthetic plastics material formed with a central aperture 122 to receive the housing 11 of the shaft 3 (FIG. 1) and formed with further apertures to receive bolts (not shown) to secure it above the plate 123 of the atomiser of FIG. 1.

A downwardly and outwardly inclined lip 124, constituting a curved laminar shrouding element, extends around approximately 150° of the periphery of the disc 121 and forms an angle of approximately 30° with the vertical (the axis of the rotary atomiser being vertical). In the present instance, the disc 121 has a diameter of approximately 13 cm and the lip 124 has a depth of approximately 2 cm and extends downwardly below the level of the peripheral edge 10 of the cone 2 of the atomiser. The lip is spaced approximately 1 cm from the peripheral edge 10 and intercepts the spray of droplets ejected from the peripheral edge throughout the 150° of arc subtended by the lip.

The droplets intercepted by the lip 124 coalesce into larger droplets and if the atomiser with the shroud 120 is mounted in a trough 73 as shown in FIGS. 11 to 13 these larger droplets will fall into the trough. Advantageously, the atomiser with the shroud 120 is so mounted and may be surrounded by arrays of bristles serving as shrouding means as shown in FIGS. 11 to 13. Alternatively, some of the arrays of bristles may be omitted when using the shroud 120 so long as arrays of bristles are used to define the arc 99 between the limiting trajectories 100 and 101 of the spray of droplets (FIG. 11).

To effect coalescing of the droplets striking it the lip 124 should be located in or close to the region of the break up into droplets of the filaments of liquid issuing from the periphery edge 10. In the case of water under the conditions mentioned above this break up of the filaments of liquid is believed to occur at approximately 0.5 cm from the peripheral edge. Advantageously, the lip 124 is located no more than 3 cm from the edge 10 and is preferably closer than 2 cm from the edge 10 and thus within about 1.5 cm of the point where the break up of the filaments is believed to occur (in the case of water).

The location of the lip 124, whilst desirably near the region of break up of the liquid filaments as mentioned should not be so close to the edge 10 as to cause splash-back onto the atomiser.

The inclination of the lip 124 means that the angle between the direction of the trajectory of the droplets and the directions of the lip is less than a right angle, in this case 60° and preferably between 50° and 70°, that is the included angle between the direction of movement of the droplets and the lip is an acute angle with the preferred values just mentioned.

The direction of rotation of the atomiser is shown by the arrow A in FIG. 14 and the leading edge 125 of the lip 124 is inclined downwardly in the direction of rotation A, that is, it is chamfered downwardly in the direction of movement of the particles impinging upon the edge 125. The trailing edge 126 of the lip 124 is also inclined downwardly in the direction of rotation A. That is it tapers downwardly to a point 127 in the direction of movement of the particles impinging upon the lip 124 in the edge region. Forming the edge 125 in this way reduces the incidence of secondary atomisation and splashing at this edge and the form of the edge 126 illustrated concentrates droplets coalescing in the region of this edge at the point 127.

We claim:

1. An apparatus for producing a spray of particles comprising means for generating a spray of particles and shrouding means arranged about the spray-producing means leaving a restricted arc or arcs over which particles can be ejected from the apparatus, characterised in that the shrouding means includes a shielding element or elements (84 to 87) comprising, or each comprising, an array of bristles and arranged about the spray-producing means so that the spray of particles produced thereby impinges directly on the array or arrays of bristles and is thereby intercepted except in the arc or arcs over which particles are to be ejected from the apparatus.

2. An apparatus according to claim 1, wherein the spray-producing means produces spray comprising a planar circular pattern of particles and the shrouding means masks the spray except in an arc or arcs of the circular spray pattern.

3. An apparatus according to claim 1, including a trough (73) above which the spray-producing means and the shrouding means are arranged so that fluent material intercepted by the shrouding means will flow down into the trough (73).

4. An apparatus according to claim 1, wherein the array of bristles of at least part of at least one shielding element (84 to 87) forms an included angle of less than a right angle with the general direction of the particles impinging upon that part of the array of bristles.

5. An apparatus according to claim 3, wherein the array of bristles of at least part of at least one shielding element (84 or 87) forms an included angle of less than a right angle with the general direction of the particles impinging upon that part of the array of bristles.

6. An apparatus according to claim 1, wherein at least one array of bristles (84 to 87) is carried by a flexible elongate element (88) so that the form and extent of the array can be adjusted.

7. An apparatus according to claim 3, wherein at least one array of bristles (84 to 87) is carried by a flexible elongate element (88) so that the form and extent of the array can be adjusted.

8. An apparatus according to claim 4, wherein at least one array of bristles (84 to 87) is carried by a flexible elongate element (88) so that the form and extent of the array can be adjusted.

9. An apparatus according to claim 1, wherein the shrouding means includes a cowling (72) located beyond the or each array of bristles (84 to 87) in relation to the spray-producing means.

10. An apparatus according to claim 1, wherein the shrouding means includes a rigid shroud (120) close to the spray-producing means.

11. An apparatus according to claim 10, wherein the spray-producing means is a rotary atomiser and the rigid shroud comprises a curved lamninar shrouding element (120) extending around the periphery of the atomiser at the level of production of the spray near the region at which filaments of liquid leaving the periphery of the atomiser break up into droplets.

* * * * *